United States Patent [19]

Peiser

[11] 4,047,004

[45] Sept. 6, 1977

[54] SIMULATION OF COMPLEX SEQUENCES OF MULTI-STAGE SEPARATORS

[75] Inventor: Alfred M. Peiser, Rocky Hill, N.J.

[73] Assignee: Mobil Oil Corporation, New York, N.Y.

[21] Appl. No.: 689,262

[22] Filed: May 24, 1976

Related U.S. Application Data

[60] Division of Ser. No. 179,984, Sept. 13, 1971, which is a continuation of Ser. No. 92,534, Nov. 24, 1970, abandoned, which is a continuation of Ser. No. 562,808, July 5, 1966, abandoned.

[51] Int. Cl.[2] ..... G05B 17/00; G06F 15/20

[52] U.S. Cl. ..... 235/151.12; 364/300

[58] Field of Search ..... 235/151.12; 444/1

[56] References Cited

U.S. PATENT DOCUMENTS 3,294,648 12/1966 Lupfer et al. ..... 235/151.12

OTHER PUBLICATIONS

Details on the London Meeting; W. R. Marshall, Jr., Chemical Engineering Progress, vol. 61, No. 4; Apr. 1965; pp. 112–120.

A New Approach to Heat and Material Balance Calculations for Equilibrium Mixtures; A. M. Peiser, A.I.C-h.E.-I. Chem. E. Symposium Series No. 4, 1965; pp. 4:93–94:100.

*Primary Examiner*—Edward J. Wise

*Attorney, Agent, or Firm*—C. A. Huggett; M. G. Gilman

[57] ABSTRACT

The computer time needed to simulate a multistage fractionating tower is decreased by programming the computer to solve the applicable equations in which there have been replaced the two principal variables, flow ratio and temperature, by a single principal variable S which is the product of the flow ratio times the equilibrium constant of a base component at each particular stage temperature. By so reducing the dimensionalities of the problem, there is achieved the reduction in computer time by successive iterative solution of the equations to achieve realistically close simulation of selected operations of the tower.

5 Claims, 8 Drawing Figures

FIG. 1
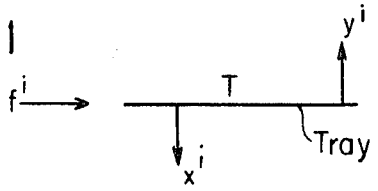
FIG. 2
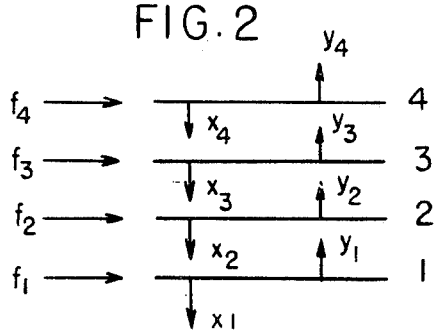
FIG. 3
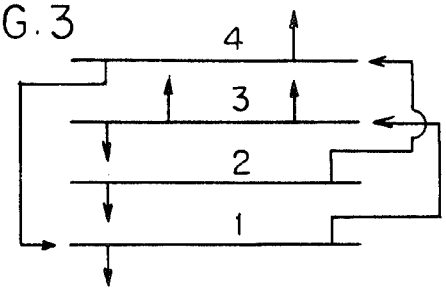
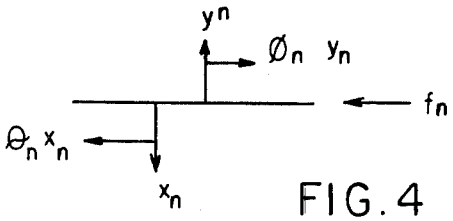
FIG. 4
FIG. 5
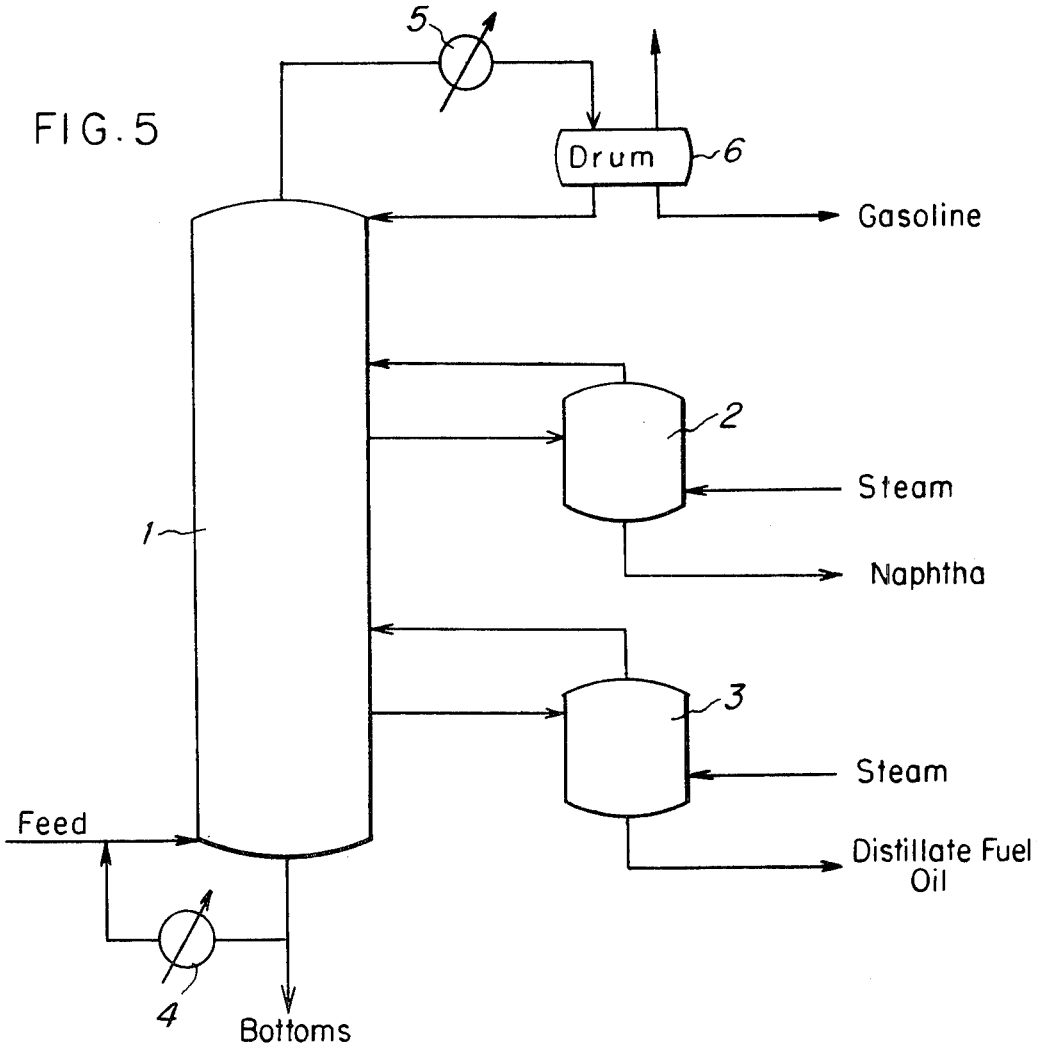

*Prediction of True Boiling Point Curves From Tower*

SIMULATION OF COMPLEX SEQUENCES OF MULTI-STAGE SEPARATORS

This application is a division of Ser. No. 179,984 filed Sept. 13, 1971 which is a continuation of application Ser. No. 92,534 filed Nov. 24, 1970, abandoned, which, in turn, is a continuation of application Ser. No. 562,808 filed July 5, 1966, abandoned.

This invention is directed to a method for the simulation and control of multi-feed and/or multi-draw, multi-stage separation processes. More particularly, this invention is directed to a new method of using a computer and a general purpose computer program designed to perform rapidly a rigorous heat and material balance. This invention is of particular use for those plants in which equilibrium vapor-liquid separation is a determining factor in plant performance.

In recent years, the use of computers has increased greatly as a means to examine by simulation techniques complex industrial processes, such as petroleum refinery operations. Digital computers are particularly valuable as a tool for exploring the complex array of mathematical statements which are representative of the interactions and restraints in the processes carried out in a refinery.

It is, of course, the computer's ability to perform calculations rapidly, and to carry out a defined calculational procedure which has led to its widespread use. However, as powerful a tool as the computer is, certain problems cannot be economically solved by it because of limitations on the amount of computer time which can be devoted to a problem, or because some problems cannot be expressed by suitable mathematical expressions with the required degree of accuracy. Rigorous solutions, particularly for complex distillation problems, are time consuming and must often be sacrificed in order to reach even approximations rapidly. This is because straightforward analytic techniques are not always available for expressing or solving non-linear problems involving an enormous number of variables. An iterative procedure is necessary for obtaining a solution. Iteration is the cyclical method by which (1) values are assumed for unknown independent variables, (2) these values are used to carry out a set of computations for related dependent variables; and (3) these dependent variables are then used to check that the mathematical equations which represent the physical requirements of the problem have been satisfied. The degree to which the equations are not satisfied provides a basis for adjusting the original independent variables after which the procedure is repeated.

Such methods require the judicious selection of independent variables based upon a thorough knowledge of the process to be simulated and a calculational procedure which will converge within a reasonable time to an accurate solution. Once a suitable simulation method is found it may be used to examine various process schemes and design modifications, and ultimately as a controller of the process being simulated.

Plate-to-plate distillation calculations were among the earliest process design applications to be solved on digital computers by iterative methods. Procedures are available in the art by which these calculations can be made conveniently and rapidly for simple distillation columns. However, for columns with multiple feeds and/or multiple products, or for complex sequences of such columns, existing plate-to-plate methods when they can be applied, have uncertain convergence characteristics and may require up to several hours time on modern computers.

It is therefore an object of this invention to provide an improved method by which a multi-feed, multi-draw, multi-stage separation process can be simulated and ultimately controlled.

Briefly, the method of this invention comprises a method for the rigorous and accurate simulation of arbitrarily connected sequences of multi-feed, multi-draw, multi-stage separations in a minimum amount of time, and the ultimate control of such separations.

The iterative procedure employed by the invention includes the classical Newton method in which convergence is achieved through the use of the rate of change (i.e. partial derivatives) of appropriate mathematical expressions with respect to suitably chosen independent variables. The ability to select these particular variables and to calculate the required partial derivatives in explicit terms, derives from simplifying assumptions concerning the physical properties of the materials involved in the separation. This invention, in part, evolves from the observation that, for many multi-component mixtures, and in particular for those involving the common hydrocarbons, the relative volatilities of the individual components are insensitive to change in temperature. This suggests that, if a solution based upon the assumption of constant relative volatilities can be obtained in a convenient manner, adjustments of the solution to account for variability of relative volatilities can be achieved without difficulty. The advantages of the assumption of constant relative volatility, as will be shown below, are first, that the dimensionality of the mathematical problem is halved, and second, that the resulting multi-variable convergence procedure can be expressed in explicit terms through the Newton method.

For the purpose of carrying out the computations, a major base component of the feed to the separation process is selected and all other components are initially assumed to have constant volatilities relative to the base component. From initial estimates of the vapor-liquid ratio and temperature at each stage, a set of simulation factors are calculated. The effects of these simultion factors on the material balance and equilibrium relations in the separator are evaluated and then verified or modified by the Newton technique to meet the required physical conditions, as for example, a heat balance at each stage. This procedure is then repeated until correct simulation factors are computed relative to the assumed constant volatilities. The values of the calculated temperatures at this point are then compared with previously assumed temperature and, if the difference is sufficiently large, the relative volatility constants are adjusted and the calculational procedure repeated.

This invention will be further defined below in conjunction with the following figures.

FIG. 1 depicts a stage in a simple flash situation.

FIG. 2 depicts the flow of material in a four-stage separation column.

FIG. 3 depicts a different flow arrangement for the separation column of FIG. 2.

FIG. 4 depicts a flow arrangement where side draws are involved.

FIG. 5 depicts a complex tower used in a specific example of this invention.

SIMPLE HEAT BALANCED FLASH

Figure 6:
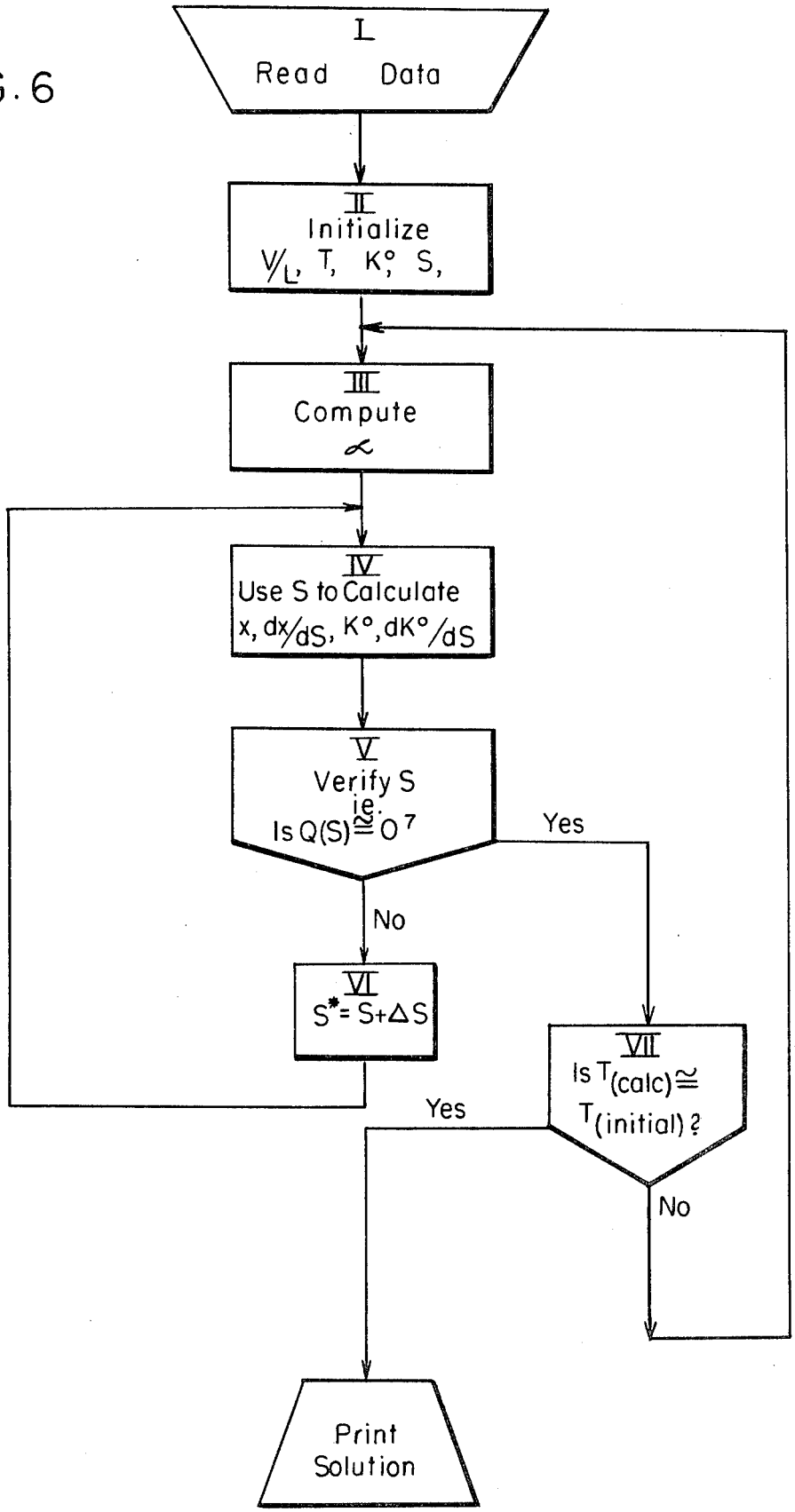
FIG. 6 is a chart of the calculational procedure used in this invention.

This invention will be first illustrated by a simple heat balanced flash calculation. The multi-feed fractionation will be shown to be a generalization of this first situation.

The feed F to a single tray is made up of $i$ feed components, $f^i$ in moles/hour (see FIG. 1). The feed is flashed into a vapour phase, V, and liquid phase, L, each made up of the components $y^i$ and $x^i$ with $V = \Sigma y^i$ and $L = \Sigma x^i$. The enthalpies of F, V and L are respectively, $H_F$, $H_V$ and $H_L$. The vapour-liquid equilibrium constants for the components (Henry's law) are $K^i$, which at a given pressure are a function of the temperature, T (the effect of composition on $K^i$ is neglected).

From the fundamental concepts of the conversation of mass and energy the following equations are obtained:

$$f^i = x^i + y^i, \text{ Material Balance} \quad (1)$$

$$0 = H_L + H_V - H_F, \text{ Heat Balance} \quad (2)$$

$$y^i/V = K^i(x^i/L), \text{ Equilibrium Balance} \quad (3)$$

Equations (1), (2) and (3) comprise 2I + 1 equations in 2I + 1 variables, $x^1, \ldots, x^I, \ldots, y^I$, and T. T is a single variable temperature which determines each $K^i$, and the enthalpies.

The following simplification may be made: Let the flow ratio R be expressed as:

$$R = V/L \quad (4)$$

Then from Eq. (3)

$$y^i = RK^i x^i \quad (5)$$

Substituting (5) into Eq. (1) yields $$(1 + RK^i)x^i = f^i \quad (6)$$

Summing Eq. (3) over all components ($i = 1, 2, \ldots, I$) yields $$\Sigma K^i x^i = \Sigma x^i. \quad (7)$$

Equations (2), (6) and (7) comprise I + 2 equations in I + 2 variables, $x^i, \ldots, x^I$, T, R. Since the $x^i$ can be calculated directly from Eq. (6) when T and R are known, this becomes a two variable (T, R) problem. It is necessary to find the values of T and R such that Eqs. (2) and (7) are satisified.

Consider the special case of constant relative volatilities $\alpha^i$ for the components $y^i$ and $x^i$. Select a base component, with K-value equal to $K^0(T)$. Then $$K^i = K^0 \alpha^i, \ \alpha^i = \text{constant} \quad (8)$$

Let $$S = RK^0 \quad (9)$$

so that, from Eq. (5), $$y^i = S\,\alpha^i x^i \quad (10)$$

The basic equations then become $$\text{Material Balance } (1 + S\,\alpha^i)x^i = f^i \quad (11)$$

$$\text{Heat Balance } 0 = H_L + H_V - H_F \quad (12)$$

$$\text{Equilibrium Balance } K^0 = (\Sigma x^i)/(\Sigma \alpha^i x^i) \quad (13)$$

Note that $T$ and $K^0$ can be used interchangeably, and $H_L$ and $H_V$ can be expressed directly in terms of either variable. For convenience, $K^0$ is used. We can write $$H_L = \Sigma x^i h_L^i(K^0) \quad (14)$$

$$H_V = \Sigma y^i h_V^i(K^0) = S\,\Sigma \alpha^i x^i h_V^i(K^0) \quad (15)$$

wherein $h_L^i$ and $h_V^i$ are the liquid and vapor enthalpies for component $i$.

Thus we have I + 2 equations in I + 2 variables — namely, $x^i \ldots x^I$, $S$, $K^0$.

The significance of this simplification (for constant volatilities) is that the problem is now a one-varible problem. For an assumed value of $S$, the $x^i$ are calculated from Material Balance (11), and $K^0$ is calculated from Equilibrium Balance (13). The correct $S$ is the one that satisfies the Heat Balance (12).

Rewrite Eq. (12) by definition as $$Q(S) \equiv H_L + H_V - H_F = 0 \quad (16)$$

This can be solved iteratively using Newton's method. For an assumed value of $S$, The next improved value is calculated from $$S' = S - \frac{Q(S)}{(dQ/dS)}, \quad (17)$$

where the symbol $d$ represents a partial derivative,

To determine $dQ/dS$, note that from Eq. (11), $$x^i = f^i/(1 + S\alpha^i)$$

so that $$\frac{dx^i}{dS} = -\frac{\alpha^i x^i}{1 + S\alpha^i} \quad (18)$$

from Eq. (13), $$\frac{dK^O}{dS} = \frac{\Sigma(1 - K^O\alpha^i)\,(dx^i/dS)}{\Sigma\alpha^i x^i} \quad (19)$$

From Eq. (14)

$$\frac{dH_L}{dS} = \Sigma\frac{dx^i}{dS}\,h_L^i(K^O) + \left[\Sigma x^i\frac{dh_L^i}{dK^O}\right]\frac{dK^O}{dS} \quad (20)$$

From Eq. (15)

$$\frac{dH_V}{dS} = \Sigma\alpha^i x^i h_V^i(K^O) + S\Sigma\alpha^i\frac{dx^i}{dS}\,h_V^i(K^O) + S\Sigma\alpha^i x^i\frac{dh_V^i}{dK^O}\,\frac{dK^O}{dS} \quad (21)$$

From Eq. (16)

$$dQ/dS = (dH_L/dS) + (dH_V/dS) \tag{22}$$

Thus, combining equations (18), (19), (20), (21), (22), $dQ/dS$ can be expressed explicitly in terms of S itself. The application of Newton's method as expressed in Eq. (17) is now completely defined.

MULTI-FEED TOWER

The foregoing approach can be generalized directly to an N-stage tower system. A four-stage tower will be used for purposes of illustration (FIG. 2). With the subscript $n$ to identify the appropriate stage, Eqs. (4), (5), (9) and (10) hold for each stage. In particular, Eq. (10) becomes:

$y_n^i = S_n \alpha_n^i x_n^i,\ n = 1, \ldots, N.$ where $L_n = \Sigma\, x_n^i$, $V_n = \Sigma\, y_n^i$, $R_n = V_n/L_n$ and $S_n = R_n K_n^o$, $n = 1, \ldots, N$.

The equilibrium equation (13) becomes $$K_n^o = \frac{\Sigma x_n^i}{\Sigma \alpha_n^i x_n^i},\ n = 1, \ldots, N. \tag{23}$$

In place of the single set of material balances (11), material balances on all stages must be satisfied simultaneously. For the case of the 4-stage tower, these can be written $$\begin{cases} (1 + S_1\alpha_1^i)x_1^i - x_2^i = f_1^i \\ -S_1\alpha_1^i x_1^i + (1 + S_2\alpha_2^i)x_2^i - x_3^i = f_2^i \\ -S_2\alpha_2^i x_2^i + (1 + S_3\alpha_3^i)x_3^i - x_4^i = f_3^i \\ -S_3\alpha_3^i x_3^i + (1 + S_4\alpha_4^i)x_4^i = f_4^i \end{cases} \tag{24}$$

In place of the single heat balance (12), the following heat balances must be satisfied simultaneously:

$$\begin{cases} Q_1 \equiv (H_{L_1} + H_{V_1}) - H_{L_2} - H_{F_1} = 0 \\ Q_2 \equiv -H_{V_1} + (H_{L_2} + H_{V_2}) - H_{L_3} - H_{F_2} = 0 \\ Q_3 \equiv -H_{V_2} + (H_{L_3} + H_{V_3}) - H_{L_4} - H_{F_3} = 0 \\ Q_4 \equiv -H_{V_3} + (H_{L_4} + H_{V_4}) - H_{F_4} = 0 \end{cases} \tag{25}$$

Computationally, this is an N-variable problem in the variables $S_1, \ldots, S_N$. For $S_1, \ldots, S_N$ assigned, the $x_n^i$'s are calculated from Eq. (24), and $K_n^o$ from Eq. (23). The correct S's are the ones for which Eq. (25) is satisfied, namely $$\begin{aligned} Q_1(S_1, \ldots, S_N) &= 0 \\ &\vdots \\ Q_N(S_1, \ldots, S_N) &= 0 \end{aligned} \tag{26}$$

This can be solved by the multi-variate Newton method, provided all partial derivatives ($dQ_n/dS_m$) are known. The extension of Eq. (17) to N dimensions is $$-Q_n = \sum_{m=1}^{N} \frac{dQ_n}{dS_m}(S_m' - S_m). \tag{27}$$

Thus, as it is possible to calculate the $Q_n$'s and the $dQ_n/dS_m$, Eq. (27) can be solved simultaneously for the new values $S_1', \ldots, S_N'$.

ORGANIZATION OF THE EQUATIONS

The material balance Eq. (24) can be written conveniently in matrix form. Let $$M^i = \begin{bmatrix} 1 + S_1\alpha_1^i & -1 & 0 & 0 \\ -S_1\alpha_1^i & 1 + s_2\alpha_2^i & -1 & 0 \\ 0 & -S_2\alpha_2^i & 1 + S_3\alpha_3^i & -1 \\ 0 & 0 & -S_3\alpha_3^i & 1 + S_4\alpha_4^i \end{bmatrix} \tag{28}$$

If $\overline{x}^i$ is a column vector representing the liquid flow of component $i$ at each stage, and $\overline{f}^i$ is a column vector representing the total feed of component $i$, then Eq. (24) can be written $$M^i \overline{x}^i = \overline{f}^i \tag{29}$$

Let $$C_L = \begin{vmatrix} 1 & -1 & 0 & 0 \\ 0 & 1 & -1 & 0 \\ 0 & 0 & 1 & -1 \\ 0 & 0 & 0 & 1 \end{vmatrix} \qquad C_V = \begin{vmatrix} 1 & 0 & 0 & 0 \\ -1 & 1 & 0 & 0 \\ 0 & -1 & 1 & 0 \\ 0 & 0 & -1 & 1 \end{vmatrix} \tag{30}$$

and let $$D_S^i = \begin{vmatrix} S_1\alpha_1^i & 0 & 0 & 0 \\ 0 & S_2\alpha_2^i & 0 & 0 \\ 0 & 0 & S_3\alpha_3^i & 0 \\ 0 & 0 & 0 & S_4\alpha_4^i \end{vmatrix}$$

The $C_L$ and $C_V$ are "configuration" matrices that define the connection between the stages or trays. Since $M^i$ can be written $$M^i = C_L + C_V D_S^i \tag{31}$$

the material balance becomes $$(C_L + C_V D_S^i)\,\overline{x}^i = \overline{f}^i \tag{32}$$

Therefore $$\overline{x}^i = (C_L + C_V D_S^i)^{-1}\overline{f}^i \tag{33}$$

In terms of $C_L$ and $C_V$, the heat balance equation (25) can be written $$\begin{vmatrix} Q_1 \\ Q_2 \\ Q_3 \end{vmatrix} = \begin{vmatrix} 1 & -1 & 0 & 0 \\ 0 & 1 & -1 & 0 \\ 0 & 0 & 1 & -1 \end{vmatrix} \begin{vmatrix} H_{L_1} \\ H_{L_2} \\ H_{L_3} \end{vmatrix} + \begin{vmatrix} 1 & 0 & 0 & 0 \\ -1 & 1 & 0 & 0 \\ 0 & -1 & 1 & 0 \end{vmatrix} \begin{vmatrix} H_{V_1} \\ H_{V_2} \\ H_{V_3} \end{vmatrix} - \begin{vmatrix} H_{F_1} \\ H_{F_2} \\ H_{F_3} \end{vmatrix} = \begin{vmatrix} 0 \\ 0 \\ 0 \end{vmatrix} \tag{34}$$

-continued

| | | | | | | | | | | | |
|---|---|---|---|---|---|---|---|---|---|---|---|
| $Q_4$ | 0 | 0 | 0 | 1 | $H_{L_4}$ | 0 | 0 | −1 | 1 | $H_{V_4}$ | $H_{F_4}$ | 0 |

Using vector notations this becomes $$\overline{Q} = C_L \overline{H}_L + C_V \overline{H}_V - \overline{H}_F = 0 \tag{35}$$

The table below indicates the similarity of the equations for a simple flash and a multi-feed tower:

| | Flash | Tower |
|---|---|---|
| Material Balance | $1 + S\alpha^i)x^i = f^i$ | $(C_L + C_V D_S^i)\overline{x}^i = \overline{f}^i$ |
| Equilibrium Balance | $K^o = \frac{\Sigma x^i}{\Sigma \alpha^i x^i}$ | $K_n^o = \frac{\Sigma x_n^i}{\Sigma \alpha_n^i x_n^i}$, n = 1,2, . . . |
| Heat Balance | $Q = B_L + H_V - H_F = 0$ | $\overline{Q} = C_L\overline{H}_L + C_V\overline{H}_V - \overline{H}_F = \overline{0}$ |

-continued

| Flash | Tower |
|---|---|
| $\frac{dx^i}{dS} \quad \frac{dx^i}{dS} = -(1 + S\alpha^i)^{-1}\alpha^i x^i$ | $\left(\left(\frac{dx_n^i}{dS_m}\right)\right) = -(C_L = C_V D_S^i)^{-1} C_V D_x^i$ |

DETERMINATION OF DERIVATIVES ($dx_n^i/dS_m$)

Consider, for example, the partial derivatives of the material balance equations (24) with respect to $S_2$. Using Eq. (29), direct differentiation yields $$M^i\left(\frac{d\overline{x}^i}{dS_2}\right) = \begin{bmatrix} 0 \\ -\alpha_2^i x_2^i \\ +\alpha_2^i x_2^i \\ 0 \end{bmatrix}$$

For the general matrix of derivatives $$M^i\left(\left(\frac{dx_n^i}{dS_m}\right)\right) = \begin{bmatrix} -\alpha_1^i x_1^i & 0 & 0 & 0 \\ +\alpha_1^i x_1^i & -\alpha_2^i x_2^i & 0 & 0 \\ 0 & +\alpha_2^i x_2^i & -\alpha_3^i x_3^i & 0 \\ 0 & 0 & +\alpha_3^i x_3^i & -\alpha_4^i x_4^i \end{bmatrix} = -C_V \begin{bmatrix} \alpha_1^i x_1^i & 0 & 0 & 0 \\ 0 & \alpha_2^i x_2^i & 0 & 0 \\ 0 & 0 & \alpha_3^i x_3^i & 0 \\ 0 & 0 & 0 & \alpha_4^i x_4^i \end{bmatrix} \tag{37}$$

Let $D_x^i$ be defined as the matrix in Eq. (37) so that $$M^i\left(\left(\frac{dx_n^i}{dS_m}\right)\right) = -C_V D_x^i$$

Then $$\left(\left(\frac{dx_n^i}{dS_m}\right)\right) = -(M^i)^{-1} C_V D_x^i$$

and from Eq. (31), $$\left(\left(\frac{dx_n^i}{dS_m}\right)\right) = -(C_L + C_V D_S^i)^{-1} C_V D_x^i \tag{38}$$

The following similarity develops for the simple flash and multi-feed tower.

| | Flash | Tower |
|---|---|---|
| $x^i$ | $x^i = (1 + S\alpha^i)^{-1} f^i$ | $x^{-1} = (C_L + C_V D_S^i)^{-1} f^{-i}$ |

With these results, and using the expressions for the derivatives of Eqs. (19), (20), (21), it is clear that the partial derivatives ($dH_{L_n}/dS_m$) and ($dH_{V_n}/dS_m$) can be calculated explicitly in terms of the quantities $S_1, \ldots, S_N$. Analogenously to Eq. (22), one obtains finally, $$\left(\left(\frac{dQ_n}{dS_m}\right)\right) = C_L\left(\left(\frac{dH_{L_m}}{dS_m}\right)\right) + C_V\left(\left(\frac{dH_{V_m}}{dS_m}\right)\right) \tag{39}$$

Thus, Eq. (39) together with Eq. (27) permits the direct application of Newton's method to the multi-feed tower.

GENERALIZATIONS OF THE SOLUTION

1. Key Specifications

The N equations required for the solutions for $S_1, \ldots, S_N$ need not be (and usually are not) all heat balance equations as in Eq. (26). As long as N independent equations are specified, the problem can be solved by minor variations of the technique outlined above.

For example, it may be required to fix the value of a key component, say $x_l^{io}$, at the bottom stage, rather than to fix $H_{fl}$ ($H_{Fl}$ can be thought of as the reboiler duty required to achieve the key specification). The heat balance equation at stage 1 now plays only a subsidiary role for the purpose of calculating $H_{Fl}$. The condition for defining $Q_1$ in Eq. (26) is the key specification.

$$Q_1 \equiv x_l^{io} - a = 0,\ a = \text{constant} \tag{40}$$

in place of the heat balance equation where ≡ is to be read "defined as."

Common conditions that could be set in place of heat balance are:

component flow:

$$Q \equiv \sum_{i=i_o}^{i_1} x^i - a = 0 \tag{41}$$

component purity:

$$Q \equiv \frac{\sum_{i=i_o}^{i_1} x^i}{\sum_{i=1}^{i_n} x^i} - a = 0 \tag{42}$$

(43)

-continued

| | |
|---|---|
| temperature: | $Q = K_o - a = 0$ |

Subscripts have been deliberately omitted in Eqs. (41), (42), (43). In principle, specifications of these or other sorts may be made at any stage of the system and may replace the heat balance requirement at any other stage of the system. In each case, the derivatives required in Eq. (39) can be calculated in a straightforward manner from Eq. (38).

2. Generalization of Flow Scheme

The matrices $C_L$, $C_V$ completely define the flow sequence and may be taken in any arbitrary manner. The definition in Eq. (30) refers to the straightforward flow sequence of FIG. 2. For a more complex case, consider the flow sequence of FIG. 3. The configuration matrices for this are:

$$C_L = \begin{vmatrix} 1 & -1 & 0 & -1 \\ 0 & 1 & -1 & 0 \\ 0 & 0 & 1 & 0 \\ 0 & 0 & 0 & 1 \end{vmatrix} \quad (44)$$

$$C_V = \begin{vmatrix} 1 & 0 & 0 & 0 \\ 0 & 1 & 0 & 0 \\ -1 & 0 & 1 & 0 \\ 0 & -1 & -1 & 1 \end{vmatrix} \quad (45)$$

and the entire analysis of Eqs. (23) - (39) may be used with these definitions of $C_L$ and $C_V$. In other words, the development here is not limited to conventional distillation schemes, but may be applied to any complex configuration of equilibrium stages, as for example, the one shown in FIG. 3 or to any complex configuration of fractionating columns such as the one shown in FIG. 5.

3. Side Draws

The general pattern for side draws is shown in FIG. 4. The effect of said draws on the material balance matrix is simply to add terms to the diagonal elements of the basic matrix $M^i$ of Eq, (28). These diagonal elements in the general case of both a liquid and a vapor side draw, become $$(1 + \theta_n) + (1 + \phi_n)\, S_n \alpha_n{}^i$$

In terms of the configuration matrices of Eq. (30), the effect of a liquid side draw at stage $n$ is to make the $n$-th diagonal of $C_L$ equal to $(1 + \theta_n)$. the effect of a vapor side draw at stage $m$ is to make the $m$-th diagonal of $C_V$ equal to $(1 + \phi_m)$. The analysis of Eqs. (23) - (39) is again unchanged except for the definition of the matrices $C_L$ and $C_V$. The values of $\theta_n$, $\phi_n$, may be assigned or may be determined by other conditions of the problem. In the latter case, $\theta_n$ or $\phi_n$ becomes an additional independent variable along with $S_1, S_2, \ldots S_N$ and thus requires an additional restraint in Eq. (26). A common constraint would be the total side draw flow which would follow the form of Eq. (41).

APPLICATIONS

One embodiment of this invention is the application of the foregoing analysis to the operation of a general purpose digital computer used to solve or control industrial processes. the foregoing analysis can readily be translated into a computer machine language, such as Fortran, by one skilled in the art of programming. In a specific example of this invention, a program was written in Fortran and was used in an IBM computer, Model 7094.

The example was directed to the simulation of the tower depicted in FIG. 5. The tower 1 comprises 14 theoretical trays and is connected with a side stripper 2 of three theoretical trays and a second side stripper 3 of two theoretical trays, a feed condenser 4 and an overhead condenser 5 connected to a flash drum 6. The feed to this tower was a catalytically cracked petroleun fraction which entered at the rate of 1760.6 moles per hour (mph), and steam at 559 mph. The overhead flash drum was maintained at 100° F and 16 psia. The gasoline was withdrawn from the drum at a specified rate of 495.1 mph, and wet gas left the drum at an unspecified rate. Naphtha was withdrawn from side stripper 2 at a specified rate of 44.9 mph, and steam entered at a rate of 16 mph; distillate fuel oil was withdrawn from side stripper 3 at 247.57 mph, and steam entered at 30 mph. The bottom tray of the tower was maintained at 600° F by condenser 4.

The general method for the calculations used in this example is set forth below. The method is also depicted by the flow chart of FIG. 6.

Step 1

Read Data
- Components of feed
- Component feed flow
- Steam rates and enthalpies of the steam
- Operating pressures
- Fixed temperatures
- Fixed yields Step 2

Assum initial values of $V_n/L_n$ and $T_n$, and select a major base component.

Calculate $K_n{}^o(T_n)$ at all trays and $S_n = (V_n/L_n)K_n{}^o$ (Eq. 9)

Step 3

Calculate $K_n{}^i(T_n)$, and calculate $\alpha_n{}^i(T_n) = K_n{}^i/K_n{}^o$ for all remaining components.

Step 4

Use values of $S_n$ to calculate from the material balances (A) $x_n{}^i$ (Eq. 33) and (B) $dx_n{}^i/dS_m$ (Eq. 38)

then calculate from these values, (C) $K_n{}^o$ (Eq. 23), $H_{L_n}$ (Eq. 14), $H_{V_n}$ (Eq. 15)

(D) $dK_n{}^o/dS_m$ (Eq. 19), $dH_{L_n}/dS_m$ (Eq. 20) $dH_{V_n}/dS_m$ (Eq. 21)

Step 5

Use Eq. (35) or the appropriate modifications in Eqs. (41), (42), (43) to verify the $S_n$'s. That is, evalute the $Q_n$'s using (A) and (C) from Step 4 and check $Q_n = 0$. If all $Q_n$'s are sufficiently close to zero, go to Step 7. If not go to Step 6.

Step 6

Using (B) and (D) from Step 4, calculate the derivatives $(dQ_n/dS_m)$ from Eq. (39). Use these derivatives and the values of $Q_n$ obtained in Step 5 in Eq. (27) to calculate new values of $S_n'$ for the variables $S_n$. Set $S_n$ equal to $S_n'$. Go to Step 4.

Step 7

If the calculated temperatures determined from the $K_n^o$'s which bring Q close to zero are equal to the initial temperatures from which the $\alpha$'s were computed, a solution has been found. If the calculated temperature is sufficiently different from the temperature at which $\alpha$ was computed, set T equal to the calculated T and go to Step 3.

This method comprises using several given values to compute an initial set of $\alpha$'s and S's. The calculational loop through Steps 4, 5, 6 and back to 4 is continued until sufficiently accurate values of S are found. These values will satisfy either a heat balance, an assigned temperature, the composition of the components on the trays, a flow rate, purity of components, etc., on each tray. Once an accurate value of S is found the temperature T (calc.) is compared with the previous temperature, T (initial) which was used to compute $\alpha$. If T (calc.) is not sufficiently close to T (initial) new values of $\alpha$ are computed from T (calc.). The computation of $\alpha$ occurs in Step 3 after which the calculational loop 4, 5, 6 and 4 is performed until a new suitable set of values of S is found, after which the newly calculated temperature is compared with previously calculated temperatures to determine whether Step 3 et seq. should again be carried out or whether a final solution has been reached.

Figure 7:
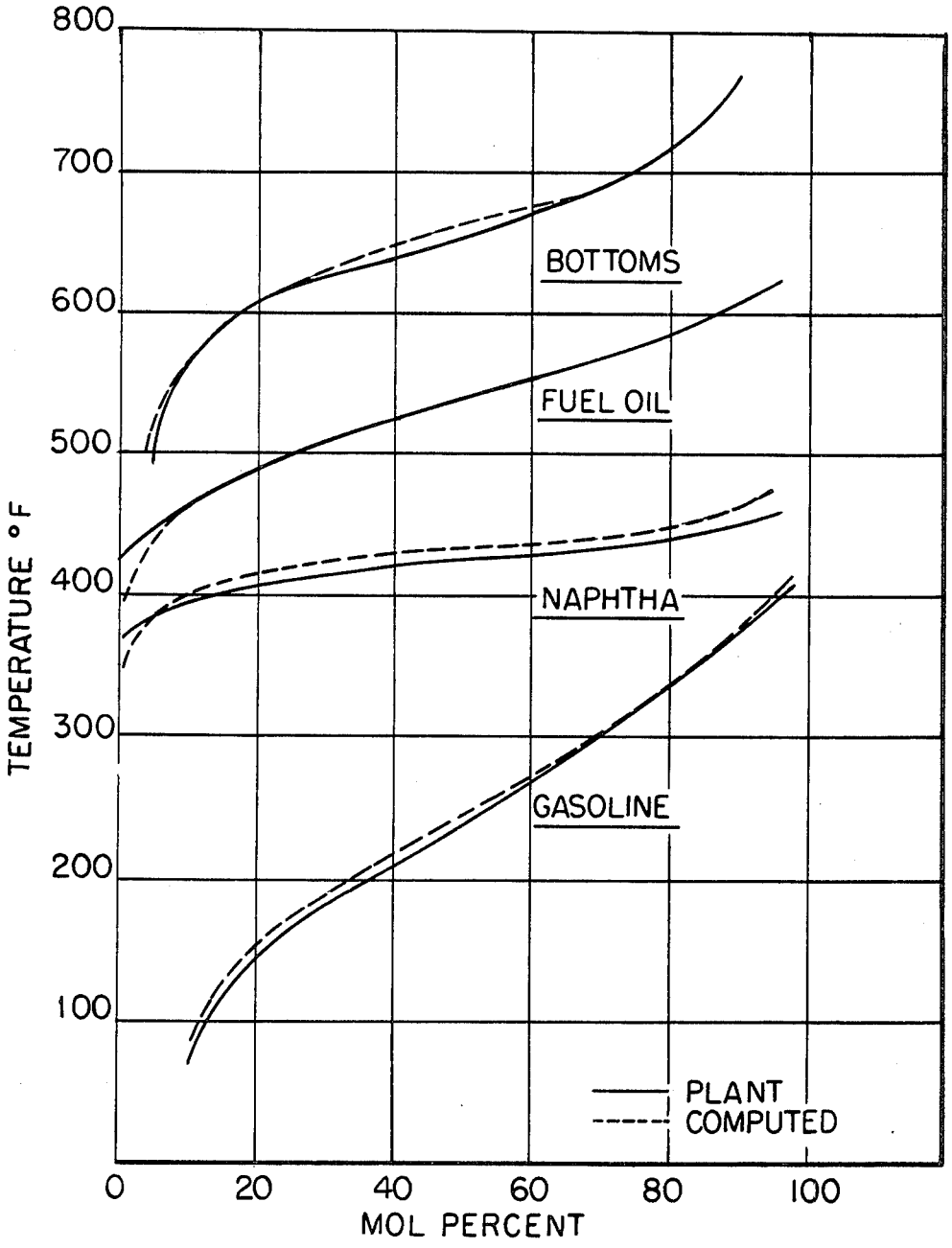
FIG. 7 is a graph of the actual and computed distillation curves for the products obtained from the tower of FIG. 5.

FIG. 7 compares the distillation curves of the product streams as computed by the method of this invention, with the distillation curves obtained by laboratory analyses of actual operations. The ordinate represents the true boiling point (T.B.P.) temperature in ° F and the abscissa represents the cumulative amount distilled at each temperature. The solid lines indicate the boiling point distribution of the product from an actual fractionating tower. The broken lines indicate the distillation curves computed by the method of this invention. FIG. 7 compares actual plant data and computed values for the distillation curves of the bottoms product withdrawn from tower 1, the naphtha withdrawn from side stripper 2, the fuel oil from side stripper 3, and the gasoline from overhead drum 6. The results show that the simulation technique employed is quite accurate. The differences between the actual and predicted values for each of the product streams are within the order of magnitude of the errors inherent in the measurement and calculation of the values involved.

An initial run on a tower of this type will take several minutes on an IBM 7094. However, once approximate values are obtained from an initial run, subsequent computations obtained upon changing a variable will require substantially less time than the original run. Thus this invention can be considered a new method for the use of general purpose digital computers whereby the computer can simulate vapor-liquid separations accurately and in a minimum amount of time.

Figure 8:
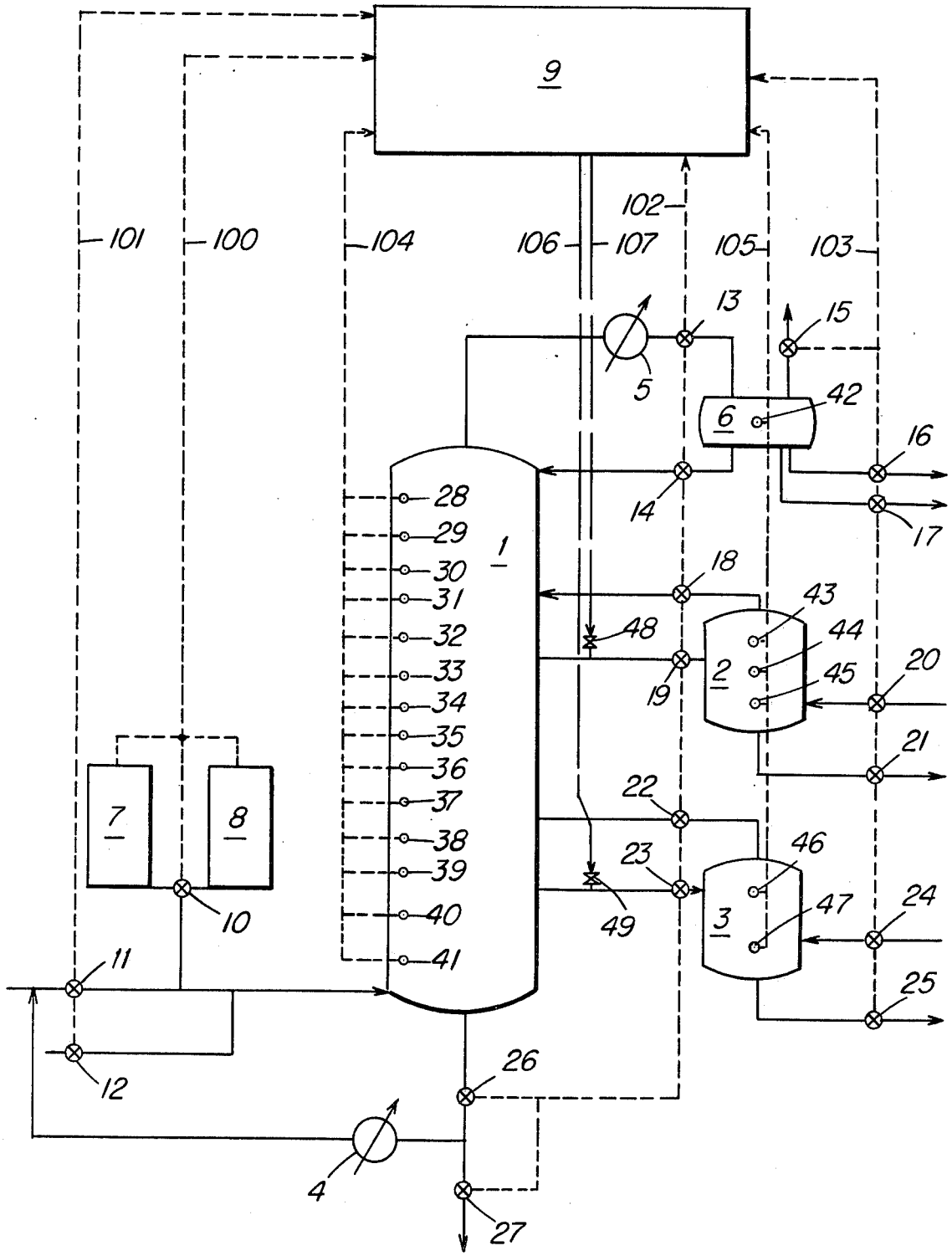
FIG. 8 is illustrative of the use of this invention in the control of a process.

FIG. 8 is an illustration of the use of this invention in the control of a fractionating tower. Reference numerals 1–6 correspond to those in FIG. 5. In addition, several analytical and control devices are provided. A sample from the feed is continuously diverted to chromatographic analyzer 7 and boiling point monitor 8. Each of these instruments is well known in the art. The data from these and other analytical instruments are transmitted to a computer 9, such as a general purpose digital computer. The computer may provide a print out such as the following based upon the analytical data received, and derived in conjunction with stored information, conversion routines, and flow rates as determined from metering devices 10, 11 and 12.

TABLE I

| INPUT FROM COMPONENT DATA | | |
|---|---|---|
| Component | Mole % In Feed | Mol Wt. |
| Hydrogen | 4.87 | 2.02 |
| Methane | 8.66 | 16.04 |
| Ethane | 5.57 | 30.07 |
| $C_3$ | 10.91 | 44.09 |
| $C_4$ | 12.33 | 58.12 |
| $C_5$ | 6.15 | 72.15 |
| $C_6$ | 4.08 | 86.00 |
| $C_7$ | 5.92 | 96.00 |
| 230° F (B.P.) | 1.90 | 104.00 |
| 260° F (B.P.) | 3.48 | 111.00 |
| 300° F (B.P.) | 3.90 | 121.00 |
| 340° F (B.P.) | 3.67 | 134.00 |
| 370° F (B.P.) | 1.59 | 145.00 |
| 390° F (B.P.) | 1.43 | 152.00 |
| 410° F (B.P.) | 1.54 | 159.00 |
| 430° F (B.P.) | 1.89 | 168.00 |
| 450° F (B.P.) | 1.18 | 176.00 |
| 470° F (B.P.) | 1.11 | 184.00 |
| 500° F (B.P.) | 3.16 | 198.00 |
| 550° F (B.P.) | 5.87 | 223.00 |
| 610° F (B.P.) | 5.12 | 255.00 |
| 666° F (B.P) | 3.51 | 289.00 |
| 733° F (B.P.) | 1.43 | 331.00 |
| 824° F (B.P.) | 0.74 | 392.00 |
| Component Flow | 1760.6 mph | |
| Steam Flow | 559 mph | |

The computer also may receive data concerning the temperature, pressure and flow rates at several other points throughout the fractionating system set forth in FIG. 8. Reference numerals 13–27 represent flow measuring devices. The following table lists representative flow rates from an actual computer simulation.

TABLE II

| FLOW MEASUREMENTS | | |
|---|---|---|
| Measurement Point | Stream | Flow (Converted to Moles Per Hour) |
| 11 | Tower Feed | 1760.6 |
| 12 | Tower Steam | 559 |
| 13 | Tower Overhead | 3376.6 |
| 14 | Tower Reflux | 2048.7 |
| 15 | Wet Gas | 832.8 |
| 16 | Gasoline | 495.1 |
| 17 | Water | 603 |
| 18 | Naphtha Stripper Recycle | 31.1 |
| 19 | Naphtha Stripper Feed | 60 |
| 20 | Naphtha Stripper Steam | 16 |
| 21 | Naptha | 44.9 |
| 22 | DFO Recycle | 60.6 |
| 23 | DFO Feed | 278.1 |
| 24 | DFO Steam | 30 |
| 25 | DFO (Distillate Fuel Oil) | 247.6 |
| 26 | Bottoms | 142.2 |

Reference numerals 28–47 represent temperature measurement devices that may be situated throughout the fractionating system. Several of these are also representative of instruments which perform pressure measurement. The following table sets forth representative data from an actual computer simulation of this system.

TABLE III

| TEMPERATURE & PRESSURE | | |
|---|---|---|
| Drum | 100° F | 16 psia |

TABLE III-continued

| | TEMPERATURE & PRESSURE | |
|---|---|---|
| Main Tower | 298.17° F (Top) | 22 psia |
| | 359.57 | |
| | 385.82 | |
| | 402.01 | |
| | 411.56 | |
| | 420.83 | |
| | 432.59 | |
| | 450.64 | |
| | 471.83 | |
| | 499.16 | |
| | 531.95 | |
| | 556.86 | |
| | 580.10 | |
| | 600.00 (Bottom) | |
| Naphtha Stripper | 393.59° F | 22 psia |
| | 376.22 | |
| | 352.92 | |
| Distillate Fuel Oil Stripper | 493.31° F | 22 psia |
| | 481.53 | |

Broken lines 100–105 represent data transmission lines which provide information to the computer from the numerous sensing points throughout the fractionating system. This data transmission system may be constructed in accordance with well-known techniques, such as multiplexing, wherein the computer continuously and sequentially scans all of the instruments. Conventional means to handle such signals, such as amplifiers and analog-to-digital converters, are not shown.

There are numerous methods by which the programming system of the present invention may be used to control a fractionating system. In a representative embodiment the information obtained from the system in FIG. 8 may be used to compute the distillation curves of the four main products of the fractionating system, i.e. gasoline, naphtha, fuel oil and bottoms, such as is shown in FIG. 7. The preparation of these charts by experimental methods is time consuming; therefore the simulated distribution curves may be of value for control purposes. If, for example, changes in the feed result in computed product distillation curves which do not conform to specifications, the computer will be able to determine the magnitude of the operating changes required to obtain products of desired quality. The computer can thereby activate appropriate changes in control settings to insure that specifications are met. This is depicted in FIG. 8 by the control lines 106 and 107 to valves 48 and 49. Alternatively, other flow rates, temperatures, pressures or yields may be used as control parameters to maintain predetermined conditions in the tower. The data from the analysis of the feed may therefore be used to determine optimum operating conditions for the tower.

The advantages of this system are readily apparent. By means of the computer system a simulation of the fractionating tower can be obtained in a very short period time. This simulation may then be used for continuous on-line control of the system, as well as for design and analysis purposes.

The invention has been described in terms of specific embodiments set forth in detail, but it should be understood that these are by way of illustration only and that the invention is not necessarily limited thereto. Alternative constructions will become apparent to those skilled in the art in view of this disclosure, and accordingly modifications of the apparatus and process disclosed herein are to be contemplated within the spirit of this invention.

What is claimed is:

1. In separation processes wherein a multicomponent feed stream in which the relative volatility of the individual components thereof are relatively insensitive to changes in temperature is supplied to a multi-stage fractionating tower, the method comprising:

performing heat, material and equilibrium balances for the stages of said tower to determine a single principal variable S at each stage representing the product of the flow ratio times the equilibrium constant of a base component at the temperature of that stage and with initially assumed values representative of constant relative volatilities of said components based upon assumed temperatures, and repeating the heat, material and equilibrium balances with new values for said constant relative volatilities based upon the newly found temperatures for the respective stages to determine a new value of the principal variable S at each stage until the last newly found temperatures substantially correspond with the assumed temperatures.

2. The method recited in claim 1 wherein said method is performed in the simulation of the operation of a multi-stage fractionating tower.

3. The method recited in claim 1 further comprising:

controlling the operation of a multi-stage fractionating tower from the temperatures and flow ratios determined from this method.

4. The method of controlling the separation process recited in claim 1 comprising:

sensing the composition of the components of said feed stream, sensing operating conditions of said tower including at least one of temperature, pressure and flow rates at different points in said tower, performing said heat, material and equilibrium balances with the sensed compositions and operating conditions to generate distillation functions for the output products of said tower, determining from said distillation curves the magnitude of the operating changes required to obtain products of desired quality, and controlling at least one of flow rates, temperatures or pressures in said tower to maintain predetermined conditions in the tower.

5. The method recited in claim 1 wherein each of the steps is carried out on a general purpose digital computer.

* * * * *

UNITED STATES PATENT AND TRADEMARK OFFICE

CERTIFICATE OF CORRECTION

PATENT NO. : 4,047,004

DATED : September 6, 1977

INVENTOR(S) : Alfred M. Peiser

It is certified that error appears in the above-identified patent and that said Letters Patent are hereby corrected as shown below:

Column 3, line 21, "conversation" should be --conservation--.

Column 4, line 21, "one-varible" should be --one-variable--.

Column 4, line 31, "The" should be --the--.

Column 4, line 37, "d" should be --$\partial$--.

Column 5, line 48, "$x_n{}^P{}_s$" should be --$x_n{}^i$'s--.

Column 5, line 59, "$(dQ_n/S_m)$" should be --$(\partial Q_n/\partial S_m)$--.

Column 7, line 3, "0" should be --$\bar{0}$--.

Column 7, line 7, before "1" insert --( --.

Column 7, line 68, "$x^{-1}$" should be --$x^{-i}$--.

UNITED STATES PATENT AND TRADEMARK OFFICE

CERTIFICATE OF CORRECTION

PATENT NO. : 4,047,004

DATED : September 6, 1977

INVENTOR(S) : Alfred M. Peiser

It is certified that error appears in the above-identified patent and that said Letters Patent are hereby corrected as shown below:

(Continued) Page 2

Column 7, line 68, "$(C_L + C_V D^i{}_S)$-1f-i" should be

--$(C_L + C_V D^i{}_S)^{-1} \frac{i}{f}$ --.

Column 8, line 19, "=" should be --+--.

Column 9, line 68, "the" should be --The--.

Column 10, line 39, "Assum" should be --Assume--.

Column 13, line 60, after "period" insert --of--.

Signed and Sealed this

*Twenty-second* Day of *January 1980*

[SEAL]

*Attest:*

SIDNEY A. DIAMOND

*Attesting Officer*

*Commissioner of Patents and Trademarks*